US008317363B2

(12) United States Patent
Zheng

(10) Patent No.: US 8,317,363 B2
(45) Date of Patent: Nov. 27, 2012

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 511 days.

(21) Appl. No.: 12/637,759

(22) Filed: Dec. 15, 2009

(65) Prior Publication Data

US 2011/0075409 A1 Mar. 31, 2011

(30) Foreign Application Priority Data

Sep. 25, 2009 (CN) ..... 2009 1 0307705

(51) Int. Cl.
*F21V 21/30* (2006.01)
*F21V 21/14* (2006.01)

(52) U.S. Cl. ..... 362/239; 362/236; 362/238; 362/231; 362/249.02; 362/249.03

(58) Field of Classification Search ..... 362/231–240, 362/249.02, 249.1, 282–284, 249.01–249.11
See application file for complete search history.

(56) References Cited

U.S. PATENT DOCUMENTS

| | | | | |
|---|---|---|---|---|
| 6,585,395 | B2 * | 7/2003 | Luk | 362/249.02 |
| 7,695,163 | B2 * | 4/2010 | Yamada et al. | 362/249.06 |
| D621,987 | S * | 8/2010 | Tsai et al. | D26/69 |
| 7,824,071 | B2 * | 11/2010 | Zheng | 362/249.02 |
| 2008/0212329 | A1 * | 9/2008 | Duguay et al. | 362/310 |
| 2009/0168422 | A1 * | 7/2009 | Chiu et al. | 362/249.03 |
| 2009/0237931 | A1 * | 9/2009 | Liu et al. | 362/249.03 |
| 2009/0244894 | A1 * | 10/2009 | Zhou et al. | 362/249.02 |
| 2011/0219650 | A1 * | 9/2011 | Wright et al. | 362/249.02 |

* cited by examiner

*Primary Examiner* — Mariceli Santiago
(74) *Attorney, Agent, or Firm* — Altis Law Group, Inc.

(57) ABSTRACT

An LED lamp includes a body, a first LED illuminant located at a side of the body and a second LED illuminant located at another side of the body opposite to the side of the body. An intersecting angle exists between the body and each of the first LED illuminant and the second LED illuminant so that light generated from the first LED illuminant and light generated from the second LED illuminant meet each other at a position above the body.

15 Claims, 4 Drawing Sheets

LED LAMP

BACKGROUND

1. Technical Field

The disclosure relates to LED (light-emitting diode) illumination devices and, particularly, to an LED lamp which can illuminate towards different directions simultaneously.

2. Description of Related Art

Conventional lamps are widely applied in sites such as tunnels to provide illumination with different directions. However, a light source of a single conventional lamp can only illuminate towards a single direction and, can not illuminate towards different directions simultaneously. In order to meet illumination demand with different directions, more than two traditional lamps must be provided.

What is needed, therefore, is a lamp which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
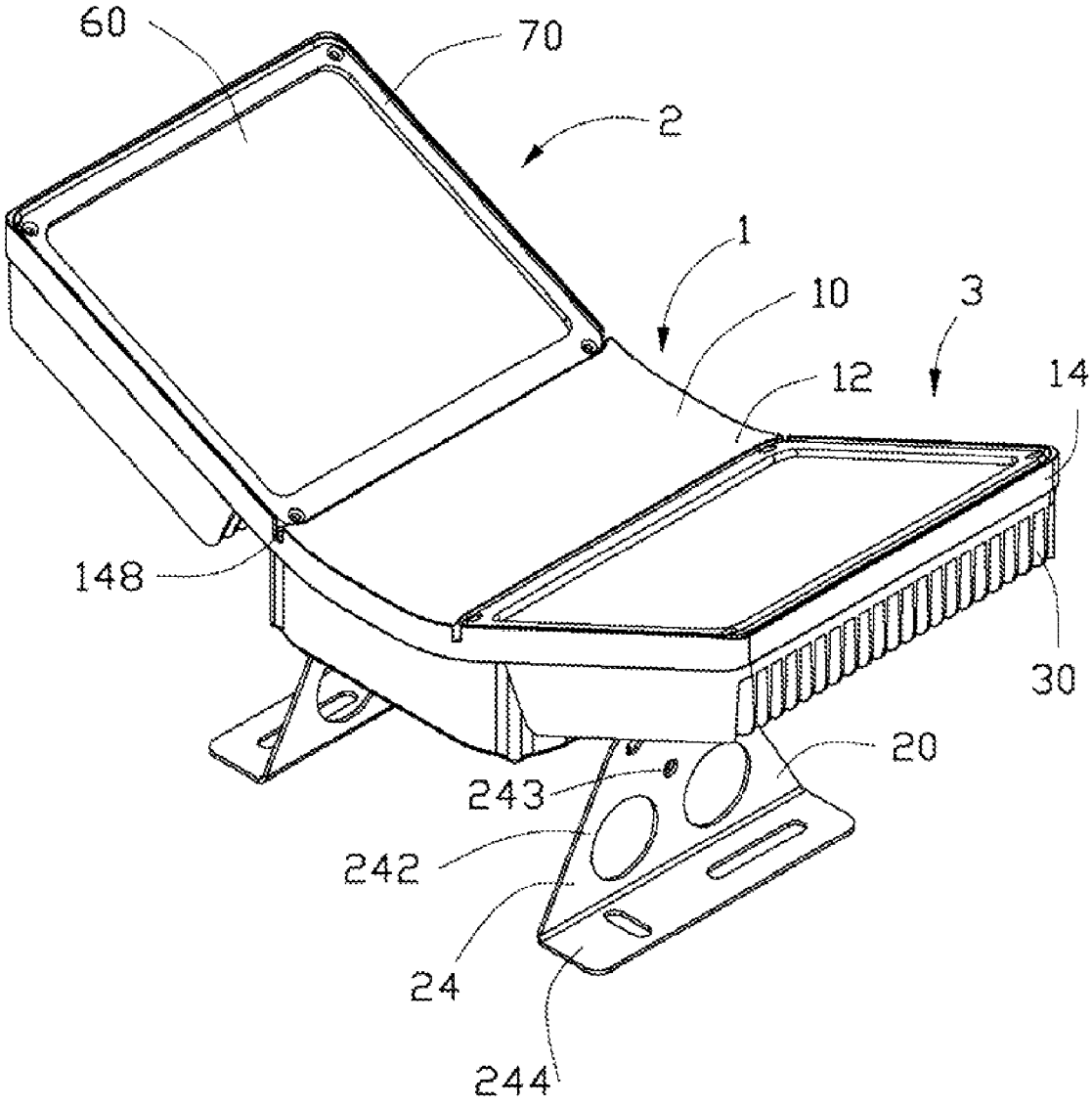
FIG. 1 is an isometric, assembled view of an LED lamp in accordance with an embodiment of the disclosure.
Figure 4:
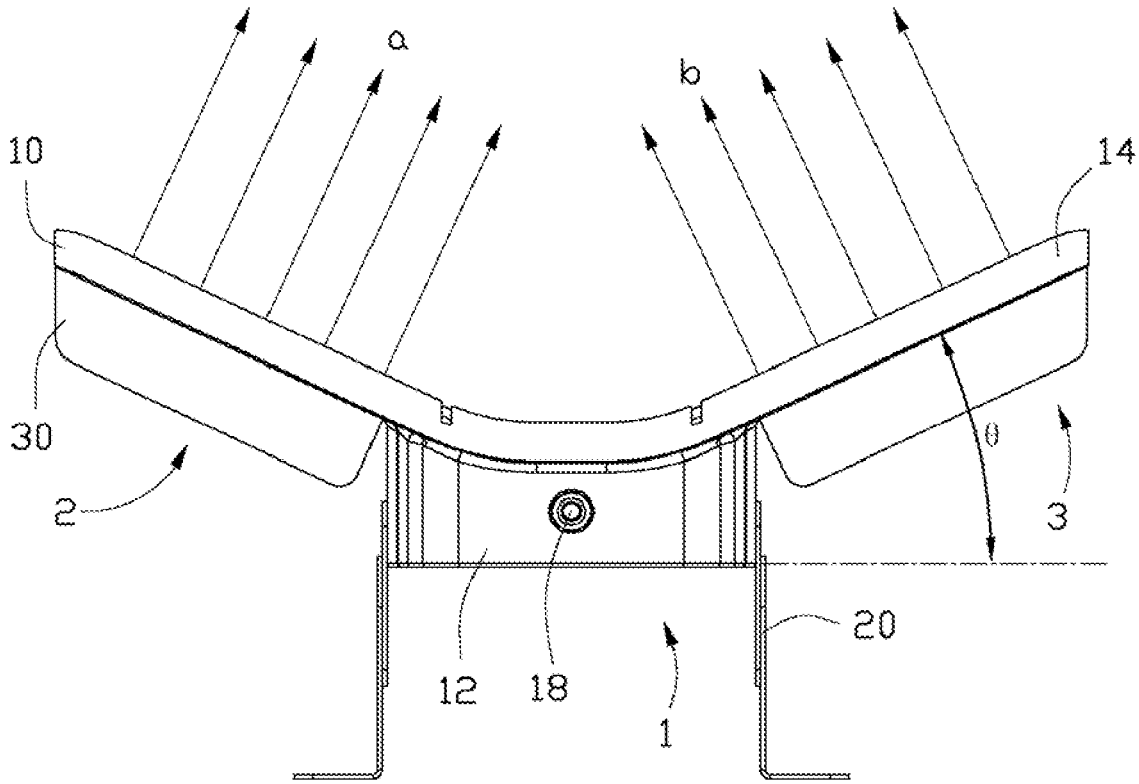
FIG. 4 is a side view of the LED lamp of FIG. 1.

Referring to FIG. 1, an LED lamp in accordance with an embodiment of the disclosure includes a body 1, a first illuminant 2 and a second illuminant 3 located at two opposite sides of the body 1, respectively. The LED lamp can be used as a tunnel lamp, a wall wash lamp or a projection lamp. An intersecting angle θ (shown in FIG. 4) exists between the body 1 and each of the first illuminant 2 and the second illuminant 3, so that light generated from the first illuminant 2 and light generated from the second illuminant 3 can meet each other at a position above the body 1.

Figure 2:
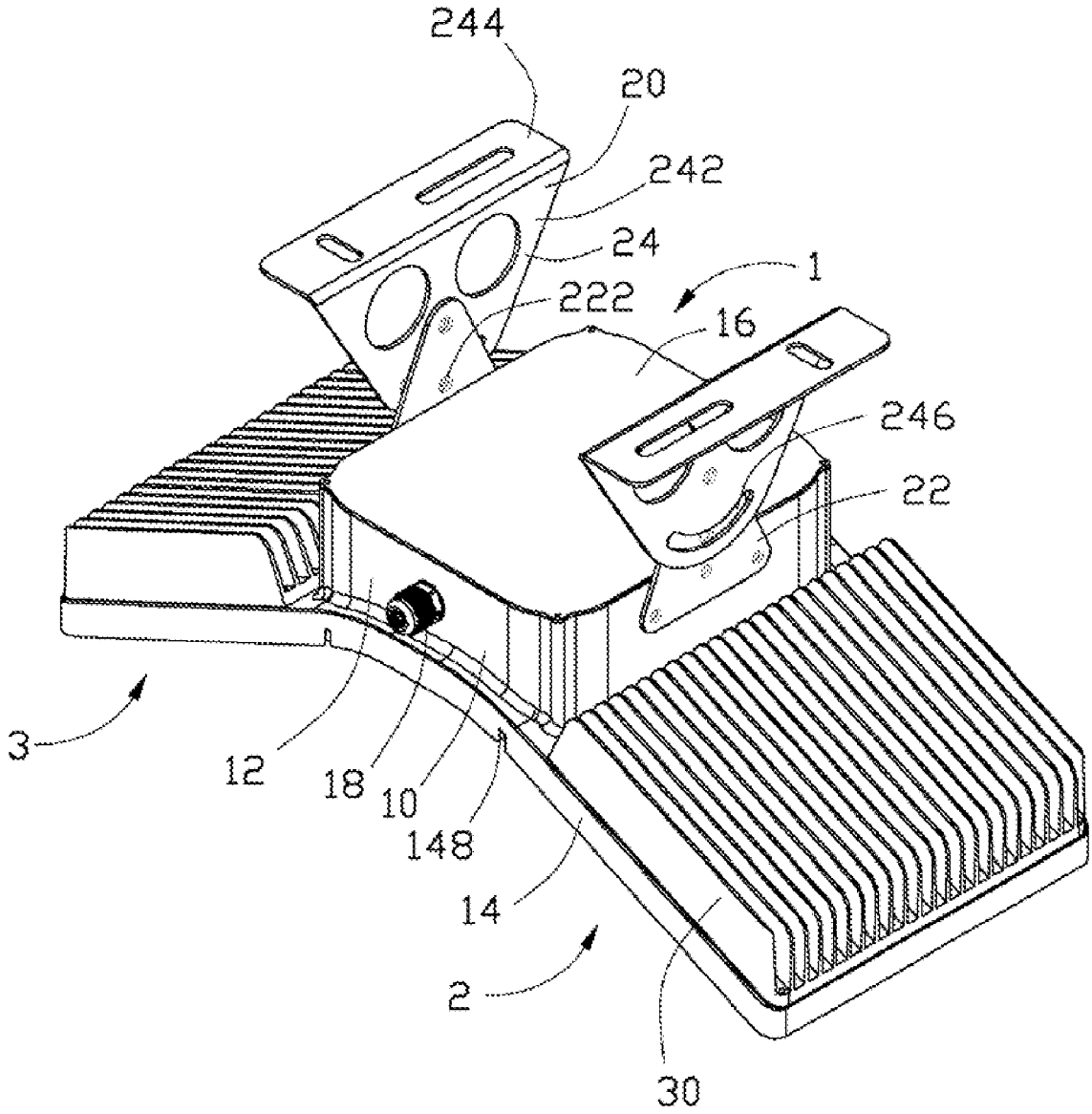
FIG. 2 is an inverted view of the LED lamp of FIG. 1.
Figure 3:
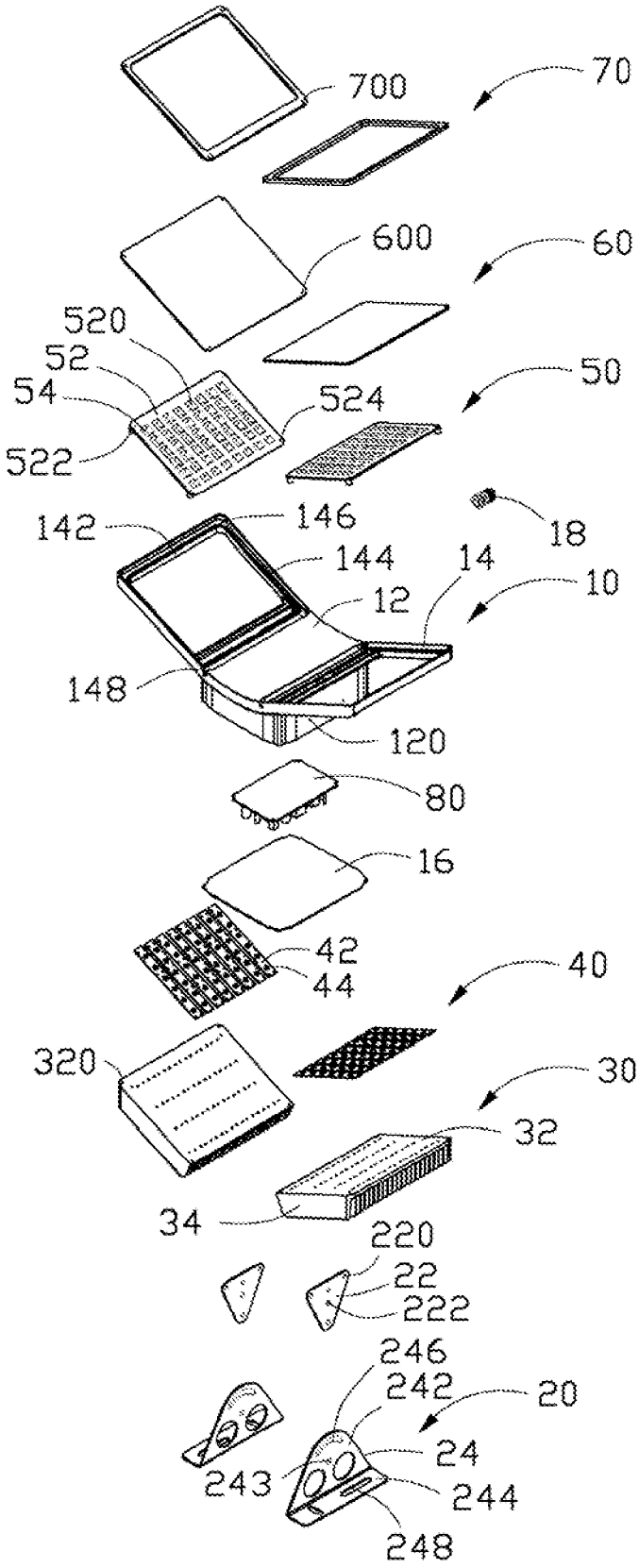
FIG. 3 is an isometric, exploded view of the LED lamp of FIG. 1.

Also referring to FIGS. 2 and 3, the body 1 includes a rectangular box-shaped body frame 12. The body frame 12 has an opening at a bottom thereof. A driving circuit module 80 is received in the body frame 12. A cover 16 covers the opening of the body frame 12 to form a sealing casing to thereby prevent rain and dust from entering into the body frame 12. The body frame 12 has a pair of longer sidewalls and a pair of shorter sidewalls connecting with the longer sidewalls. Each of the longer sidewalls defines two fixing holes 120 for engaging with screws (not shown) to fasten a bracket 20 thereon. A water-proof connector 18 is mounted at one of the pair of shorter sidewalls for a power wire extending therethrough to connect with the driving circuit module 80 in the body frame 12.

Each of the first illuminant 2 and the second illuminant 3 includes a rectangular illuminant frame 14, a heat sink 30 mounted at a bottom of the illuminant frame 14, an LED module 40 adhered on the heat sink 30, a light guiding module 50 received in the illuminant frame 14 and covering the LED module 40, a transparent envelope 60 received in the illuminant frame 14 and covering the light guiding module 50, and a cover plate 70 pressing the envelope 60. The illuminant frames 14 of the first and second illuminants 2, 3 extend slantwise and upwardly from tops of the two opposite longer sidewalls of the body frame 12 of the body 1, respectively. The illuminant frames 14 of the first and second illuminants 2, 3 integrally extend from the body frame 12 and cooperatively form a frame 10 with the body frame 12. Each illuminant frame 14 includes a rectangular base wall 142 and three side walls 144 extend upwardly from an outer edge of the base wall 142. The three side walls 144 and a corresponding longer side of the body frame 12 together define a receiving room. Two side walls 144 connecting with the body frame 12 each define a water slot 148 through which water accumulated in top of the LED lamp can be drained away. The base wall 142 defines four through holes 146 in four corners thereof.

Each bracket 20 includes a connecting plate 22 and a supporting foot 24. The connecting plate 22 generally is a triangular metal plate, and defines a through hole 220 in each corner thereof. The connecting plate 22 is positioned in an inverted manner. Two screws extend through two through holes 220 in a top of the connecting plate 22 and are screwed into the two fixing holes 120 of the longer sidewall of the body frame 12. The connecting plate 22 defines an indicating hole 222 in a center thereof. The supporting foot 24 is formed by bending a metal plate, and includes a body 242 and a supporting portion 244 perpendicularly, horizontally and outwardly extending from a bottom end of the body 242. The supporting portion 244 defines two elongated through holes 248 for screws (not shown) extending therethrough to mount the LED lamp on a mounting plane (such as ground, a wall or a ceiling). The body 242 defines a pivot hole 243 in a center thereof. A rivet extends through a through hole 220 in a bottom of the connecting plate 22 and the pivot hole 243 of the body 242 to pivotedly connect the connecting plate 22 and the supporting foot 24 together, whereby the frame 10 is pivotably mounted on the supporting feet 24 of the brackets 20. Another end of the body 242 opposite to the supporting portion 244 has an arc-shaped edge and defines an arc-shaped slide hole 246 below and along the arc-shaped edge. When the frame 10 rotates relative to the supporting foot 24, the indicating hole 222 of the connecting plate 22 can rotate along the arc-shaped slide hole 246 simultaneously to indicate the rotating angle of the frame 10 relative to the supporting foot 24. At the desired rotated angle, a screw (not shown) extending through the indicating hole 222 and the slide hole 246 is tightly connected with a nut (not shown) to securely fix the frame 10 at the position.

Each heat sink 30 is made of metal such as aluminum, copper or an alloy thereof. The heat sink 30 includes a substantially rectangular plate-shaped base 32 and a plurality of fins 34 vertically and downwardly extending from a bottom face of the base 32. A top face of the base 32 defines a plurality of mounting holes (not labeled). Four fixing holes 320 are defined in four corners of the base 32, and located corresponding to the through holes 146 of the base wall 142 of the frame 10.

Each of the LED modules 40 includes a plurality of elongated printed circuit boards 42 and a plurality of LEDs 44 mounted on each of the printed circuit boards 42. The LEDs 44 are arranged in a row. The printed circuit board 42 defines a plurality of through holes (not labeled) arranged in a row, corresponding to a row of the mounting holes of the base 32. A plurality of screws (not shown) extend through the through holes of the printed circuit board 42 and are screwed into the corresponding mounting holes of the base 32 to mount the LED module 40 on the base 32 of the heat sink 30. Heat conductive glue (not shown) is applied between a bottom of the printed circuit board 42 and a top of the base 32 to help heat transfer from the LEDs 44 to the heat sink 30. The two LED modules 40 illuminate light with different colors, shown as arrows a, b in FIG. 4. Due to the angle θ between the body frame 12 and each of the illuminant frames 14, the lights a, b with different colors generated from the two LED modules 40 at the two opposite sides of the body frame 12 meet each other at a position above the body frame 12, whereby a light with a third color is generated by a mixture of the two lights a, b of different colors.

Each light guiding module 50 includes a rectangular main body 52 placed over a corresponding LED module 40 and a plurality of reflectors 54 formed in the main body 52. The main body 52 defines a plurality of through holes 520, corresponding to the LEDs 44 on the printed circuit boards 42. Each hole 520 is surrounded by a corresponding reflector 54. When the light guiding modules 50 are assembled to the illuminant frames 14, respectively, the LEDs 44 are received in the holes 520 and surrounded by the reflectors 54, respectively. Four positioning posts 522 each defining a through hole 524 therein protrude from four corners of a bottom of the main body 52. To assemble the light guiding module 50 to the illuminant frame 14, the positioning posts 5222 are brought to be positioned on the base wall 142 of the illuminant frame 14 at positions wherein the through holes 146 are defined. Thus, the through holes 524 communicate with the respective through holes 146.

Each envelope 60 can be made of glass, polycarbonate (PC), polymethyl methacrylate (PMMA) or other suitable material. The envelope 60 is received in the illuminant frame 14. The envelope 60 defines four through holes 600 in four corners thereof, corresponding to the through holes 146 of the illuminant frame 14. The two envelopes 60 can be made of materials with different colors to make light extending through the envelopes 60 change color.

The cover plate 70 has a rectangular, loop-shaped structure corresponding to four sides of the envelope 60. The cover plate 70 defines a four through holes 700 in four corners thereof, corresponding to the through holes 600 of the envelope 60.

In assembly, the LED modules 40 are screwed and glued on the bases 32 of the heat sinks 30. The base 32 of the heat sink 30 is brought to abut against a bottom of the base wall 142 of a corresponding illuminant frame 14. The light guiding modules 50 are disposed in the two illuminant frames 14 of the frames 10 in a manner as disclosed above. The envelopes 60 are disposed in the illuminant frames 14 and cover the light guiding modules 50. The cover plates 70 are placed on the envelopes 60. The heat sinks 30 with the LED modules 40 thereon are disposed on the bottom of the illuminant frames 14. Eight screws (not shown) are brought to extend through the through holes 700 of the cover plates 70, the through holes 600 of the envelopes 60, the positioning posts 522 of the light guiding modules 50 and the through holes 146 of the illuminant frames 14 in sequence and finally engage in the fixing holes 320 of the heat sinks 30 to assemble the cover plates 70, the envelopes 60, the light guiding modules 50, the frame 10 and the heat sinks 30 together, thereby to complete the assembly of the LED lamp in accordance with the present disclosure.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED lamp comprising:

a body;

a first LED illuminant located at a side of the body; and a second LED illuminant located at another side of the body opposite to the side of the body;

wherein an intersecting angle exists between the body and each of the first LED illuminant and the second LED illuminant so that light generated from the first LED illuminant and light generated from the second LED illuminant meet each other at a position above the body;

wherein the first LED illuminant illuminates light with a first color, and the second LED illuminant illuminates light with a second color, and the light with the first color and the light with the second color meet each other at a position above the body to generate light with a third color; and wherein the first LED illuminant comprises a first envelope with a first color, the second LED illuminant comprises a second envelope with a second color different from the first color.

2. The LED lamp as claimed in claim 1, wherein the first LED illuminant comprises a plurality of LEDs emitting light with the first color, and the second LED illuminant comprises a plurality of LEDs emitting light with the second color different from the first color.

3. The LED lamp as claimed in claim 1, wherein the body comprises a body frame, each of the first LED illuminant and the second LED illuminant comprising an illuminant frame, a heat sink mounted on the illuminant frame and an LED module secured on the heat sink, the illuminant frames of the first LED illuminant and the second LED illuminant being connected to the two opposite sides of the body frame.

4. The LED lamp as claimed in claim 3, wherein the illuminant frames of the first and second LED illuminants integrally extend slantwise and upwardly from the two opposite sides of the body frame of the body.

5. The LED lamp as claimed in claim 3, wherein the heat sink comprises a base and a plurality of fins extending from the base, each LED module comprises a plurality of printed circuit boards and a plurality of LEDs mounted on a side of each of the printed circuit boards, another side of each of the printed circuit boards is secured on the base of the heat sink.

6. The LED lamp as claimed in claim 5, wherein each illuminant frame comprises a rectangular base wall and three side walls extending upwardly from an outer edge of the base wall, the three side walls and a side of the body frame together surround a receiving room for receiving the LED module therein.

7. The LED lamp as claimed in claim 6, wherein two of the three side walls connecting with the body frame each define a water slot for drain of water accumulated on a top of the LED lamp.

8. The LED lamp as claimed in claim 7, further comprising two light guiding modules received in the illuminant frames and covering the LED modules, each light guiding module comprising a main body placed over corresponding printed circuit boards and a plurality of reflectors formed in the main body, a periphery of the main body being located over the base wall of the illuminant frame, the reflectors surrounding the LEDs on the corresponding printed circuit boards, respectively.

9. The LED lamp as claimed in claim 8, further comprising two envelopes received in the illuminant frames and covering the light guiding modules, the two envelopes being made of materials with different colors from light generated by the LEDs to make the light generated by the LEDs change color after passing through the envelopes.

10. The LED lamp as claimed in claim 9, further comprising two cover plates received in the illuminant frames, and the envelopes are pressed between the cover plates and the light guiding modules.

11. The LED lamp as claimed in claim 3, further comprising two brackets connected to two sides of the body frame, each bracket comprising a connecting plate connecting the body frame and a supporting foot pivotedly connected to the connecting plate.

12. The LED lamp as claimed in claim 11, wherein the supporting foot comprises a body and a supporting portion extending from the body for mounting the LED lamp on a mounting plane.

13. The LED lamp as claimed in claim 12, wherein the body of the supporting foot defines an arc-shaped slide hole, the connecting plate defining an indicating hole, when the body frame rotates relative to the supporting foot, the indicating hole of the connecting plate rotating along the arc-shaped slide hole simultaneously to indicate the rotating angle of the body frame relative to the supporting foot.

14. An LED lamp comprising:

a body;

a first LED illuminant located at a side of the body; and a second LED illuminant located at another side of the body opposite to the side of the body;

wherein an intersecting angle exists between the body and each of the first LED illuminant and the second LED illuminant so that light generated from the first LED illuminant and light generated from the second LED illuminant meet each other at a position above the body;

wherein the body comprises a body frame, each of the first LED illuminant and the second LED illuminant comprising an illuminant frame, a heat sink mounted on the illuminant frame and an LED module secured on the heat sink, the illuminant frames of the first LED illuminant and the second LED illuminant being connected to the two opposite sides of the body frame;

wherein the heat sink comprises a base and a plurality of fins extending from the base, each LED module comprises a plurality of printed circuit boards and a plurality of LEDs mounted on a side of each of the printed circuit boards, another side of each of the printed circuit boards is secured on the base of the heat sink; and wherein each illuminant frame comprises a rectangular base wall and three side walls extending upwardly from an outer edge of the base wall, the three side walls and a side of the body frame together surround a receiving room for receiving the LED module therein.

15. An LED lamp comprising:

a body;

a first LED illuminant located at a side of the body; and a second LED illuminant located at another side of the body opposite to the side of the body;

wherein an intersecting angle exists between the body and each of the first LED illuminant and the second LED illuminant so that light generated from the first LED illuminant and light generated from the second LED illuminant meet each other at a position above the body;

wherein the body comprises a body frame, each of the first LED illuminant and the second LED illuminant comprising an illuminant frame, a heat sink mounted on the illuminant frame and an LED module secured on the heat sink, the illuminant frames of the first LED illuminant and the second LED illuminant being connected to the two opposite sides of the body frame; and wherein the LED lamp further comprises two brackets connected to two sides of the body frame, each bracket comprising a connecting plate connecting the body frame and a supporting foot pivotedly connected to the connecting plate.

* * * * *